United States Patent [19]

Volfson

[11] 4,411,044

[45] Oct. 25, 1983

[54] CORD WEIGHT PULLEY

[75] Inventor: Boris Volfson, Middleton, Wis.

[73] Assignee: Graber Industries, Inc., Middleton, Wis.

[21] Appl. No.: 341,858

[22] Filed: Jan. 22, 1982

[51] Int. Cl.[3] ..... A47H 11/06; E05D 17/00

[52] U.S. Cl. ..... 16/219; 248/325

[58] Field of Search ..... 16/97, 107, 210, 211, 16/215, 216, 217, 219, 193, 194, 196, 202, 208, 209; 248/325, 329, 331, 332, 328, 330.1, 564, 579

[56] References Cited

U.S. PATENT DOCUMENTS 369,952 9/1887 Matteson ..... 16/219

*Primary Examiner*—E. R. Kazenske
*Assistant Examiner*—John S. Brown
*Attorney, Agent, or Firm*—Vernon J. Pillote

[57] ABSTRACT

A cord weight pulley assembly for traverse rod installations in which the housing is formed in one piece and includes a first housing section having a lower weight receiving cavity and an upper pulley receiving cavity, a second housing section integrally connected to the first housing section and movable to a closed position overlying the weight receiving cavity, and a third housing section integrally connected to the second housing section and movable to a closed position overlying the pulley receiving cavity.

8 Claims, 8 Drawing Figures

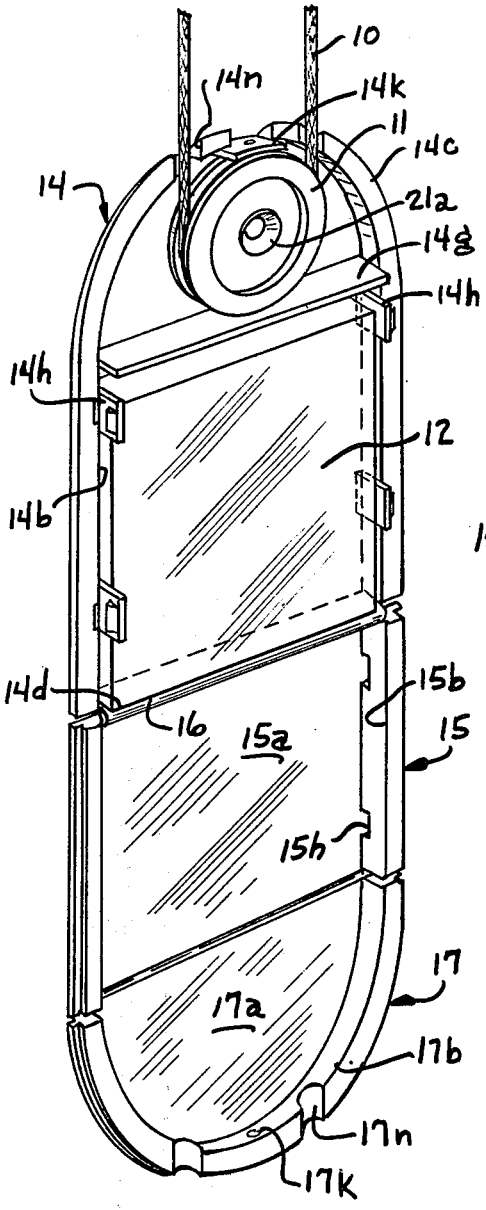
Fig. 1.
Fig. 2.
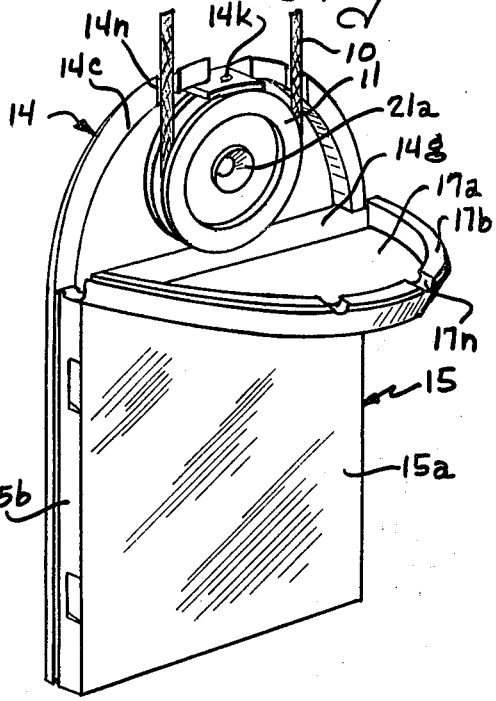
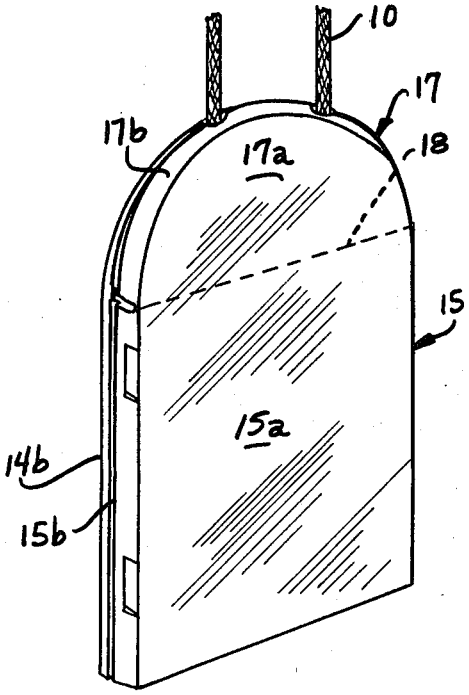
Fig. 3.

CORD WEIGHT PULLEY

BACKGROUND OF THE INVENTION

Cord weight pulley assemblies have heretofore been provided for use in traverse rod installations where the operating cords are arranged in a loop, to tension and maintain the operating cords in a desired position. In one prior cord weight pulley assembly, the pulley is mounted in a pulley housing that is detachably secured to a separate housing that encloses the cord weight. In another prior cord weight pulley assembly, the pulley and cord weight are disposed between two housing half-sections that snap together. However, in order to attach or remove the pulley from the cord loop, it is necessary to remove one housing half-section from the other and this not only exposes the pulley but also the cord weight. Further, if the snap fittings for connecting the housing half-section are constructed and arranged to provide a very firm interlocking of the housing half-sections, as would be desirable to retain the cord weight against accidental discharge from the housing, then the housing is difficult to open in order to install or remove the pulley from the cord loop.

SUMMARY OF THE INVENTION

It is an object of the present invention to provide a cord weight pulley assembly for traverse rod installation which utilizes a one-piece housing which can be folded and closed to completely enclose the cord weight and to overlie opposite sides of the pulley to retain the cord weight pulley assembly on the cord loop, and in which the housing can be partially opened to allow attachment or removal of the cord loop from the pulley, without exposing the cord weight.

Accordingly, the present invention provides a cord weight pulley assembly comprising a one-piece housing formed of synthetic resin material and including a first housing section having a lower weight receiving cavity and an upper pulley receiving cavity at an inner side thereof, a second housing section integrally connected along one edge by a first flexible hinge portion to one edge of the first housing section and adapted to be flexed along the first hinge portion relative to the first housing section into a closed position in overlying relation to the weight receiving cavity, and a third housing section integrally connected at one edge by a second flexible hinge portion to a second edge of the second housing section and adapted to be flexed along the second flexible hinge portion relative to the second housing section when the latter is in its closed position into and out of a closed position in overlying relation to the pulley receiving cavity in the first housing section, a cord guide pulley in the pulley receiving cavity, a weight in a weight receiving cavity, and means for maintaining the second housing section in its closed position on the first housing section.

These, together with other objects, features and advantages of the present invention will become apparent from the following description when taken in connection with the accompanying drawings wherein:

FIG. 1 is a perspective view of the cord weight pulley assembly with the housing in an open condition;

FIG. 2 is a perspective view of the cord weight pulley assembly with the housing partially opened for attachment of the pulley assembly in a cord loop;

FIG. 3 is a perspective view of the cord weight pulley assembly with the housing in a fully closed condition;

Figure 5:
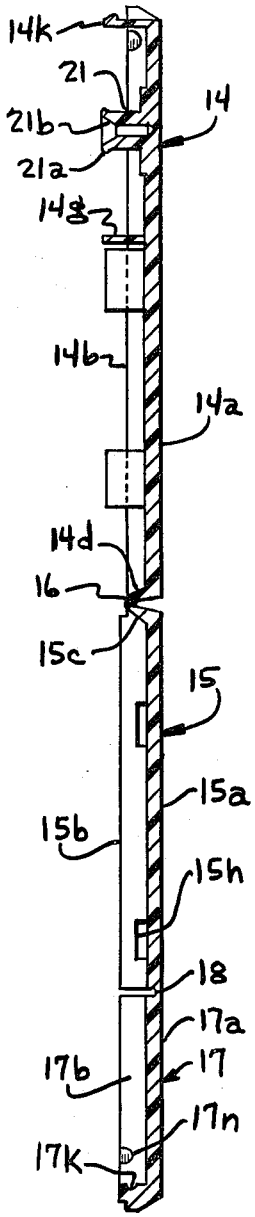
FIG. 5 is a longitudinal sectional view through the housing taken on the plane 5—5 of FIG. 4.

The cord weight pulley assembly is adapted for use in traverse rod installations where the operating cord is arranged to have a downwardly extending loop portion 10 intermediate its ends. The cord weight pulley assembly is suspended on the loop portion of the operating cord to tension the operating cords and to maintain the operating cords in a desired position. In general, the cord weight pulley assembly includes a pulley 11 for engaging the downwardly extending loop portion 10 of the traverse cords, a weight 12, and a housing 13 for enclosing the weight and pulley. In accordance with the present invention, the housing is formed in one piece of a synthetic resin material and includes a first housing section 14, a second housing section 15 that is integrally connected along one edge by a first flexible hinge portion 16 to one edge of the first housing section, and a third housing section 17 that is integrally connected along one edge by a second flexible hinge portion 18 to a second edge of the second housing section 15. The first housing section 14 forms one side of the housing and the second and third housing sections, when closed, overlie different portions of the first housing section and form the other side of the housing. More particularly, the second housing section 15 is foldable along the flexible hinge portion 16 into overlying relation with a lower portion of the first housing section to define a lower weight receiving cavity therebetween and the third housing section 17 is foldable relative to the second housing section, when the latter is in its closed position, into a closed position overlying the upper portion of the first housing section to define a pulley receiving cavity therebetween. The housing can be formed of any suitable synthetic resin material which is sufficiently flexible to provide the desired flexible hinge portions when formed in thin cross-sections and may, for example, be formed of polypropylene. As best shown in FIG. 5, the first, second and third housing sections have relatively thicker cross-sections than the hinge portions so that the housing sections are sufficiently stiff to be shape retaining in normal use.

Figure 4:
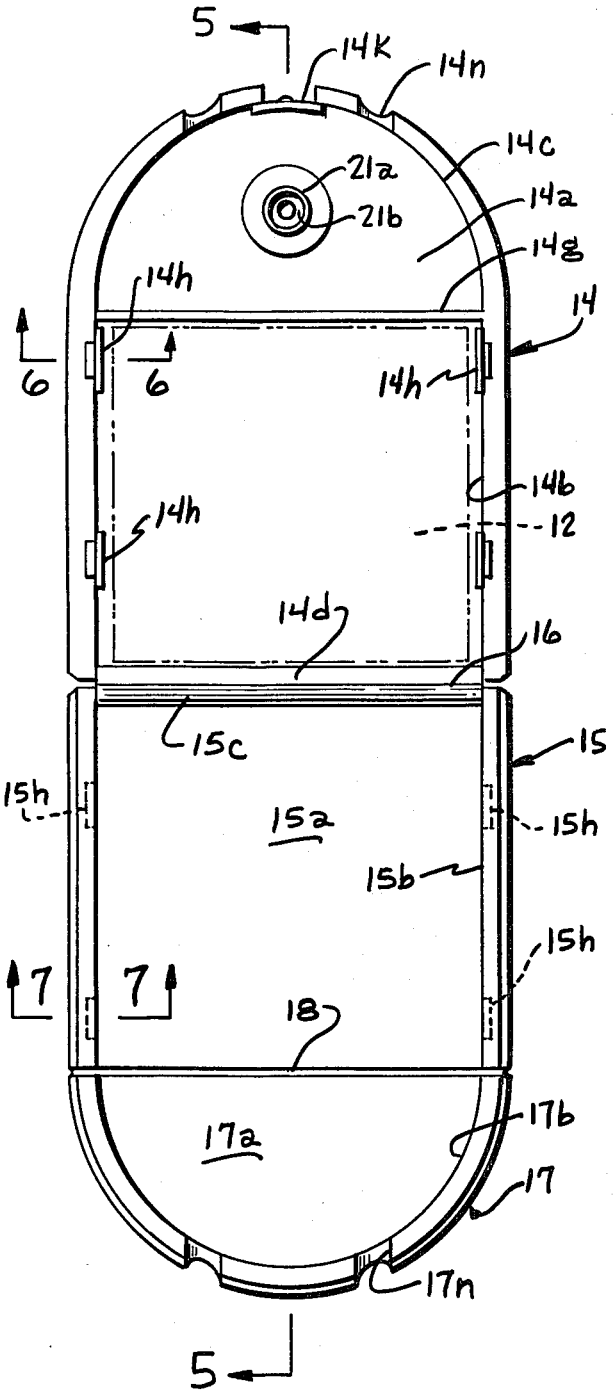
FIG. 4 is a side elevational view of the housing in an open condition.

The first housing section includes a face wall **14*a* having flange portions 14*b* along the opposite sides and flange portions 14*c* and 14*d* along the top and bottom respectively of the face wall and which define a recess at the inner side of the face wall. The second housing section has a face wall 15*a* and lateral flange portions 15*b* along opposite sides and a flange portion 15*c* along one edge of the face wall, and which define a recess at the inner side of the second housing section. The first hinge portion 16 integrally connects the flange portion 15*c* on the second housing section to the flange portion 14*d* on the first housing section for swinging movement about an axis generally coplanar with inner edges of the flange portions on the first and second housing sections, between a position generally coplanar with the first housing section, as shown in FIGS. 1, 4 and 5, and a closed position as shown in FIG. 2 in which the second housing section overlies the lower portion of the first housing section. The third housing section has a face wall 17***a* and a flange portion 17*b* along its outer margin that extends laterally from the face wall 17*a* and defines a recess at the inner side of the face wall. The second flexible hinge portion 18 interconnects the third housing section to the second housing section for hinged movement relative thereto about a hinge axis adjacent the outer face of the face walls 15*a* and 17*a*, so that the third housing section can swing relative to the second housing section between a closed position overlying the upper portion of the first housing section as shown in FIG. 3, and an open position away from the upper portion of the first housing section as shown in FIG. 2.

Figure 8:
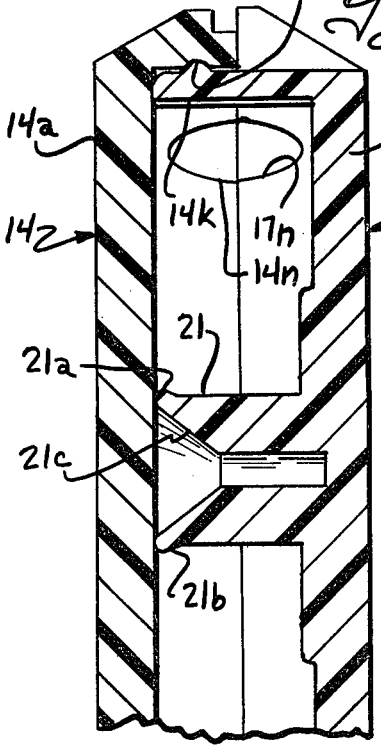
FIG. 8 is a fragmentary transverse sectional view taken on the plane 5—5 of FIG. 4 and illustrating the pulley housing latch on a larger scale than FIG. 4.

The pulley 11 is mounted in the upper portion of the housing and is preferably supported solely on the first housing section. For this purpose, a pulley support spindle 21 is molded integrally with the inner side of the face wall 14*a* of the first housing section for rotatably supporting the pulley 11. The spindle 21 is conveniently formed with a rim 21*a* at its distal end having a diameter slightly larger than the internal opening in the pulley adapted to radially contract and allow the pulley to snap over the rim during assembly of the pulley. As best shown in FIG. 8, the rim 21*a* has a generally conical outer portion 21*b* that diverges in a direction toward the distal end of the spindle and a conical inner wall 21*c*, and the angle of the cone 21*c* is made much greater than the angle of the conical outer portion 21*b* to facilitate removal of the mold.

As previously described, the weight 12 is disposed in the lower weight receiving cavity formed between the second housing section 15 and the lower portion of the first housing section. The weight may, for example, comprise a piece of metal of a suitable size and thickness to provide the desired weight. The weight receiving cavity is preferably separated from the pulley receiving cavity by a divider wall 14*g* so that the weight is not visible when the pulley receiving cavity is open. As shown, the divider wall 14*g* is provided on the inner side of the first housing section 14 between the weight receiving cavity and the pulley receiving cavity. The divider wall 14*g* preferably has a depth greater than the depth of the flanges 14*b* to extend to the face wall 15*a* of the second housing section, when the latter is closed, as shown in FIG. 2.

Figure 6:
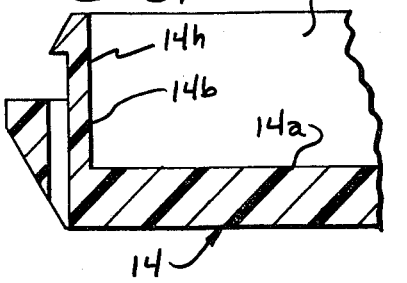
FIG. 6 is a fragmentary transverse sectional view through the housing taken on the plane 6—6 of FIG. 4 and showing the parts on a larger scale.
Figure 7:
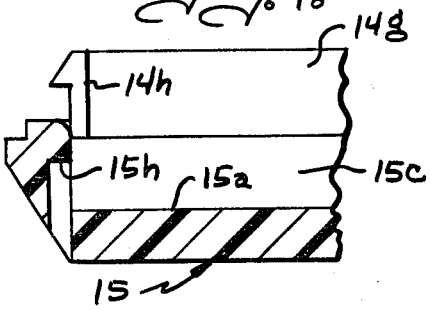
FIG. 7 is a fragmentary transverse sectional view taken on the plane 7—7 of FIG. 4 and showing the parts on a larger scale than FIG. 4.

Latches are provided for latching the second housing section 15 to the first housing section, when the second housing is closed. The latches are conveniently formed integrally with the housing and include latch portions 14*h* formed on the flange portions 14*b* of the first housing section and keepers 15*h* formed on the flanged portion 15*b* of the second housing section. Since the lower weight receiving cavity does not have to be re-opened once the weight is positioned in the cavity, the latches 14*h* and keepers 15*h* are preferably located at the inner side of the respective housing section so as to be concealed when the second housing section is closed on the first housing section. As best shown in FIGS. 6 and 7, the nose portion of the latches 14*h* is inclined to cam over the inner side of the flange on the second housing section when the latter is moved to its closed position, and the inner face of the nose on the latch 14*h* and the face of the keeper 15*h* are disposed generally perpendicular to the path of relative movement of the first and second housing sections so as to firmly lock the first and second housing sections in a closed position.

A separate latch is provided for releasably latching the third housing section 17 in a closed condition overlying the upper portion of the first housing section. This latch includes a resilient latch member 14*k* formed on the first housing section and which is arranged to engage a keeper 17*k* on the third housing section. It is desirable to be able to re-open the pulley receiving cavity for attachment and/or removal of the traverse cord from the pulley 11 and the latch 14*k* and keeper 17*k* are arranged to facilitate re-opening of the pulley receiving cavity. As shown in FIG. 8, a nose portion on the latch 14*k* is rounded and the keeper recess 17*k* is similarly rounded so that the latch can snap into and out of the keeper with substantially equal facility. In addition, a recess 14*m* is provided in the flange portion above the latch 14*k* so that the latch is accessible when the third housing section is closed, and can be depressed to further facilitate re-opening of the third housing section. Notches 14*n* and 17*n* are provided in the flange portions of the first housing section and third housing section respectively to allow passage of the runs of the traverse cords into and out of the upper pulley cavity.

With the above arrangement it will be seen that the housing can be readily molded in one piece with the first, second and third housing sections in a generally planar condition. The weight 12 is then positioned in the weight receiving cavity on the first housing section and the pulley is assembled on the spindle 21. The second housing section is then folded into overlying relation with the lower portion of the first housing section and latched into a closed position by latches 14*h* and keepers 15*h* to enclose and retain the weight. The third housing section can thereafter be moved into and out of a position overlying the pulley receiving cavity in the upper portion of the first housing section, to allow attachment or removal of the traverse cord loop from the pulley. The cord weight pulley assembly is economical to fabricate and assemble and, when the second housing section is latched in its closed position, it provides an enclosing housing for the cord weight that cannot be accidentally re-opened. The pulley housing section, however, can be re-opened without re-opening of the weight receiving cavity.

The embodiments of the invention in which an exclusive property or privilege is claimed are defined as follows:

1. A cord weight pulley assembly for traverse rod installations comprising, a one-piece housing formed of synthetic resin material and including a first housing section having a lower weight receiving cavity and an upper pulley receiving cavity at an inner side thereof, a second housing section integrally connected along one edge by a first flexible hinge portion to one edge of the first housing section and adapted to be flexed along the first hinge portion relative to the first housing section to a closed position in overlying relation to said weight receiving cavity, and a third housing section integrally connected at one edge by a second flexible hinge portion to a second edge of the second housing section and adapted to be flexed along the second flexible hinge portion relative to the second housing section, when the latter is in its closed position, into and out of a closed position in overlying relation to the pulley receiving cavity in the first housing section, cord guide pulley means in said pulley receiving cavity, weight means in said weight receiving cavity, and means for retaining said second housing section in its closed position on said first housing section.

2. A cord weight pulley assembly according to claim 1 wherein said second flexible hinge portion extends parallel to said first flexible hinge portion.

3. A cord weight pulley assembly according to claim 1 wherein said second housing section and said third housing sections are disposed generally coplanar with each other and with said first housing section when said first and second integral hinge portions are in their initial unflexed condition.

4. A cord weight pulley assembly according to claim 1 wherein the first flexible hinge portion is at the lower edge of the lower weight receiving cavity and said second flexible hinge portion extends generally parallel to said first flexible hinge portion.

5. A cord weight pulley assembly according to claim 1 including latch means for releasably retaining said third housing in its closed position on said first housing section.

6. A cord weight pulley assembly according to claim 1 wherein the first housing section has a first face wall and said second and third housing sections have second and third face walls respectively, the combined area of the second and third face walls approximating the area of the first face face wall, the first and second housing sections having flange means that extend between the first and second face walls and form said weight receiving cavity when said second housing section is closed, and said first and third housing sections having flange means that extend between the first and third face walls and define said pulley receiving cavity when said third housing section is closed.

7. A cord weight pulley assembly according to claim 6 wherein said first flexible hinge portion extends along the lower edge of the weight receiving cavity and the second flexible hinge portion extends generally parallel to the first flexible hinge portion.

8. A cord weight pulley assembly according to claim 6 wherein the first flexible hinge portion defines a flex-line in a plane substantially medially between said first and second face walls and said second flexible hinge portion defines a flex-line substantially in the plane of said second and third face walls.

* * * * *